United States Patent [19]

Osawa et al.

[11] Patent Number: 5,051,327

[45] Date of Patent: Sep. 24, 1991

[54] METHOD FOR OIL-DENSENSITIZATION TREATMENT OF LITHOGRAPHIC PRINTING PLATE

[75] Inventors: Sadao Osawa, Shizuoka; Hiromichi Tachikawa; Hiroaki Yokoya, both of Kanagawa, all of Japan

[73] Assignee: Fuji Photo Film Co., Ltd., Kanagawa, Japan

[21] Appl. No.: 318,216

[22] Filed: Mar. 2, 1989

[30] Foreign Application Priority Data

Mar. 2, 1988 [JP] Japan ..... 63-49353

[51] Int. Cl.[5] ..... G03G 13/26

[52] U.S. Cl. ..... 430/49; 430/302

[58] Field of Search ..... 430/49, 54, 302

[56] References Cited

U.S. PATENT DOCUMENTS 4,719,162 1/1988 Nakano et al. ..... 430/49

4,880,716 11/1989 Kato et al. ..... 430/49

*Primary Examiner*—John Goodrow

*Attorney, Agent, or Firm*—Sughrue, Mion, Zinn Macpeak & Seas

[57] ABSTRACT

A method for oil-densensitization treatment of a lithographic printing plate is disclosed, comprising treating the plate with an aqueous solution containing a silicate represented by the formula $SiO_2/M_2O$ (wherein M is an alkali metal atom) and a water-soluble resin.

6 Claims, No Drawings

METHOD FOR OIL-DENSENSITIZATION TREATMENT OF LITHOGRAPHIC PRINTING PLATE

FIELD OF THE INVENTION

The present invention relates to a method for an oil-desensitization treatment of a lithographic printing plate produced by an electrophotographic process.

BACKGROUND OF THE INVENTION

As lithographic offset printing plates, PS (presensitized) plates and the like, using a positive light sensitizer containing a diazo compound and a phenolic resin as main components, or a negative light sensitizer containing an acryl monomer or prepolymer as a main component, are now in practical use. However, since these printing plats are of low sensitivity, platemaking is conducted by bringing a silver salt photographic film original plate previously imagewise recorded into initimate contact and then exposing to light.

With computer image processing, storage of large volumes of data, and advances of data communication technology, an electronic editing system in which input of an original, correction, editing, layout and further paging are totally processed with a computer, and which permits output to terminal plotters at a remote plate by the use of a high speed communication network or a satellite communication has now come into practical use. This electronic editing system is highly desirable in the field of newspaper printing needing instantaneous communication. Also, in fields in which an original is stored as an original film, and, based on this film, a printing plate is copied, if necessary, with the advance of development of super high volume recording media such as a light disk, it is considered that the original is stored as digital data in the recording media.

A direct printing plate in which a printing plate is produced directly from an output of a terminal plotter has not almost been put into practical use. Even in fields in which the electronic editing system works, data are output to a silver salt photographic film, and, based on this, intimate contacting and exposure to light are applied indirectly to a PS plate to produce a printing plate. This is due to the fact that it is difficult to develop a direct printing plate having a sufficiently high sensitivity to permit production of a printing plate within a practially allowable time by the use of a light source of an output plotter (e.g., He-Ne laser or semiconductor laser).

An electrophotographic light-sensitive material can be considered as a light-sensitive material having a high light-sensitivity capable of providing a direct printing plate.

As printing plate materials (printing original plates) utilizing electrophotography, for example, zinc oxide-resin dispersion type offset printing plate materials as described in JP-B-47-47610, JP-B-48-40002, JP-B-48-18325, JP-B-51-15766 and JP-B-51-25761 (the term "JP-B" as used herein means an "examined Japanese patent publication") have heretofore been known. These materials are used, after forming a toner image by the electrophotographic method and then wetting with a solution to make non-image areas oil-desensitive (e.g., an acidic aqueous solution containing a ferrocyanide or a ferricyanide). An offset printing plate subjected to such treatment possesses printing durability such that about 50,000 to 100,000 sheets can be printed, and is unsuitable for printing more than 100,000 sheets. It also has disadvantages, in that if the composition is changed so as to be suitable for the treatment, electrostatic characteristics are deteriorated and image quality is reduced. Furthermore, the solution uses a toxic cyanic compound.

Inorganic photoconductive material-resin based printing plate materials as described in JP-B-37-17162, JP-B-38-7758, JP-B-46-39404 and JP-B-52-2437, for example, an electrophotographic light-sensitive material produced by providing a photoconductive insulating layer in which oxazole or an oxadiazole or an oxadiazole compound is bound with a styrene-maleic anhydride copolymer, on a grained aluminum plate is used. On this light-sensitive material, a toner image is formed by the electrophotographic process and then non-image areas are removed with an alkaline organic solvent to produce a printing plate.

JP-A-57-147656 (the term "JP-A" as used herein means an unexamined published Japanese patent application) discloses an electrophotographic light-sensitive material containing a hydrazone compound and barbituric acid or thiobarbituric acid. In addition, JP-A-59-147335, JP-A-59-152456, JP-A-59-168462 and JP-A-58-145495 disclose an electrophotographic light-sensitive material in which dye is sensitized. However, in non-image areas of a printing plate produced using the above electrophotographic light-sensitive material, a substance in the electrophotographic light-sensitive layer is adsorbed, leading to contamination of the non-image areas. Due to the attachment of ink to the nonimage areas of prints and staining, the printing plate is not satisfactory for use as a printing plate. U.S. Pat. No. 3,181,461 describes that a so-called PS plate obtained by treating an anodized aluminum plate with an alkali metal silicate solution, and coating a light-sensitive layer exhibits good resistance against contamination of non-image areas. However, a printing plate using an electrophotographic light-sensitive material in which a photoconductive layer is provided on a substrate subjected to surface treatment with an alkali metal silicate generally has poor printing durability and is unsuitable for practical use.

In the production of a lithographic printing plate, a so-called gum solution is coated in the final step.

This gum solution coating is applied not only for the purpose of protecting hydrophilic properties of non-image areas but also for the purpose of protecting against contamination or scratching due to attachment of finger prints, oils and dust during storage until image areas are written or removed, or until printing is conducted after plate making, or until reuse, or during the attachment or handing of a printing machine. Further it is applied for the purpose of preventing contamination of the surface due to oxidation.

As a gum solution for a lithographic printing plate, an aqueous solution of gum arabic, cellulose gum or a water-soluble polymeric substance has heretofore been used. This gum solution, however, when a large amount of an organic contamination substance is adsorbed thereon, is poor in an oil-desensitization capability and is contaminated.

When contamination due to the above causes is generated, a step of removing organic contaminating substances is needed. A contamination removing solution to be used for the above purpose is commercially available (for example, Plate Cleaner CU-3 produced by Fuji Photo Film Co., Ltd.). Such an additional step is undesirable because of a reduction in workability.

SUMMARY OF THE INVENTION

An object of the present invention is to provide a method for oil-desensitization treatment of a lithographic printing plate which is useful for removing contaminating substances from a lithographic printing plate produced by an electrophotographic process, and at the same time, for making the plate oil-desensitive and further for protecting the plate surface.

Another object of the present invention is to provide a method for oil-desensitization treatment of a lithographic printing plate produced by an electrophotographic process, using an oil-desensitizing solution which can be easily applied to the plate by the use of e.g., sponge, cotton swab, or gum coater, can be easily removed from the lithographic printing machine by washing with water or contacting with the feed roller of printing machine, and further which maintains hydrophilic properties of non-image areas.

In accordance with the present invention, it was found that a silicate removes substances responsible for contamination of the surface of a plate and at the same time, makes non-image areas oil-desensitive, and moreover, use of a water-soluble resin in combination prevents the plate surface from coming into direct contact with air. Thus, a reduction in oil-desensitivity of non-image areas due to oxidation and so forth is prevented, and the effect of increasing oil-desensitivity is obtained. Moreover, print contamination due to attachment of stains to the plate surface until the plate is placed on a printing machine is prevented, and the plate is protected against scratching when it is stored such that it is placed on other plates, or it bumps with other members.

Thus, the present invention is directed to a method for oil-desensitization treatment of a lithographic printing plate, which comprises treating a lithographic printing plate having image areas of toner image formed by an electrophotographic process on a photoconductive layer provided on an electrically conductive substrate, and non-image areas of the electrically conductive substrate, which method comprises treating the plate with an aqueous solution containing a silicate represented by the formula $SiO_2/M_2O$ (wherein M indicates an alkali metal atom), and a water-soluble resin.

DETAILED DESCRIPTION OF THE INVENTION

As the silicate to be used in the present invention, sodium silicate, potassium silicate, and lithium silicate can be used. The molar ratio of $SiO_2$ to $M_2O$, i.e., $SiO_2/M_2$, is preferably in the range of from 0.5/1 to 8.5/1.

The amount of the silicate used in a lithographic printing plate oil-desensitizing solution to be used in the present invention is from about 0.4 to 40% by weight, preferably from about 0.8 to 25% by weight, based on the total weight of the compositions in the solution.

Examples of water-soluble resins which can be used in the present invention include the following materials.

Natural polymers such as starch, e.g., sweet potato starch, potato starch, tapioca starch, wheat starch, and corn starch, those obtained from algaes, e.g., corrageenan, liminarin, marine algae mannan, funori, Irish moss, agaragar, and sodium alginate, vegetable mucilages, e.g., bihiscus, mannan, quince seeds, pectin, tragacanth gum, karaya gum, xanthine gum, guar gum, locust been gum, gum arabic, carob gum, and benzoin gum, mucilage modified utilizing fermentation of microorganisms, e.g., homopolysaccharides such as dextran, glucan, and levan, and heteropolysaccharides such as succinoglucan and xanthan gum, and protein, e.g., glue, gelatin, casein, and collagen, can be used. In addition to alginic acid propolylene glycol ester as a modified natural product, fiber derivatives, e.g., viscose, methylcelluloe, ethylcellulose, methylethylcellulose, carboxymethylcellulose, hydroxypropylcellulose, hydroxypropylmethylcellulose, hydroxypropylethylcellulose and hydroxypropylmethylcellulose phthalate, and processed starch can be used. Examples of the processed starch include roasted starch, e.g., white dextrin, yellow dextrin and British gum, enzyme-modified dextrin, e.g., enzyme dextrin and schardinger dextrin, acid decomposed starch, e.g, solubilized starch, oxidized starch, e.g., dialdehyde starch, alpha starch, e.g., modified alpha starch and non-modified alpha starch, esterified starch, e.g., phosphoric acid starch, fatty acid starch, sulfuric acid starch, nitric acid starch, xanthogenic acid starch and carbamic acid starch, etherized starch, e.g., carboxyalkyl starch, hydroxyalkyl starch, sulfoalkyl starch, cyanoethyl starch, allyl starch, benzyl starch, carbamylethyl starch and dialkylamino starch, cross-linked starch, e.g., methylol cross-linked starch, hydroxyalkyl cross-linked starch, phosphoric acid cross-linked starch and dicarboxylic acid cross-linked starch, and starch graft polymers, e.g., starch polyacrylamide copolymer, starch polyacrylic acid copolymer, starch polyvinyl acetate copolymer, starch polyacrylonitrile copolymer, cationic starch polacrylate copolymer, cationic starch vinyl polymer copolymer, starch polystyrene maleic acid copolymer and starch polyethylene oxide copolymer. Examples of synthetic starch include, in addition to polyvinyl alcohol, modified polyvinyl alcohol, e.g., partially acetalized polyvinyl alcohol, allyl modified polyvinyl alcohol, polyvinyl methyl ether, polyvinyl ethyl ether and polyvinyl isobutyl ether, polyacrylic acid derivatives and polymethacrylic acid derivatives, e.g., sodium polyacrylate, polyacrylate partially saponified product, polyacrylate copolymer partially saponified product, polymethacrylic acid salt, and polyacrylamide, polyethylene glycol, polyethylene oxide, polyvinyl pyrrolidone, a copolymer of polyvinyl pyrrolidone and vinyl acetate, carboxyvinyl polymer, a styrene maleic acid copolymer, a styrene crotonic acid copolymer, and the like.

The water-soluble resin content is preferably from 1 to 30% by weight, and more preferably from 3 to 25% by weight. If the content is less than 1% by weight, the effect is decreased, and if it is more than 30% by weight, oil sensitivity of image areas is decreased, and a large number of prints should be printed until a print having a satisfactory ink density can be obtained.

These water-soluble resins can be used alone or as mixtures comprising two or more thereof.

The oil-desensitizing solution for lithographic printing plates which is to be used in the present invention may contain various known components, if desired in addition to the silicic acid salt and the water-soluble resin.

For example, addition of a surface active agent improves the state of the surface of a coating. Examples of surface active agent which can be used for this purpose include anionic agents, nonionic agent, amphoteric agent and cationic agents.

Examples of the anionic surface active agents include fatty acid salts, alkylbenzenesulfonic acid salts, straight chain alkylbenzenesulfonic acid salts, alkylsulfuric acid salts, α-olefinsulfonic acid salts, alkylphosphoric acid ester salts, dialkylsulfosuccinic acid ester salts, polyoxyethylene alkyl ether sulfuric acid salts, polyoxyethylene alkyl ether phosphoric acid salts, alkylnaphthalenesulfonic acid salts, N-lauroylsarcosine salts, naphthalene formalin condensate sulfonic acids, and diphenyl ether disulfonic acid salts. Examples of the nonionic surface active agents include polyoxyethylene alkyl ethers, polyoxyethylene alkylphenol ethers, polyoxyethylene, polyoxypropylene block polymers, polyoxyethylene sorbitan fatty acid esters, polyoxyethylene glycerine fatty acid esters, polyoxyethylene fatty acid amines, fatty acid monoglycerides, sorbitan fatty acid esters, pentaerythritol fatty acid esters, saccharide fatty acid esters, and amine oxides. Examples of the amphoteric surface active agents include alkylcarboxybetaine type surfactants, alkylaminocarboxylic acid type surfactants, and alkylimidazoline type surfactants. Examples of the cationic surface active agents include tetraalkylammonium salts, trialkylbenzylammonium salts, and alkylimidazolium salts. In addition, fluorine-containing surfactants, silicon-containing surfactants, and the like can be used.

Of these surface active agents, anionic and/or nonionic surface active agents are particularly effective. These surface active agents can be used as mixtures comprising two or more thereof. The amount of the surface active agent used is preferably from about 0.01 to about 10% by weight, based on the weight of the oil-desensitizing solution, although it is not critical.

Water functions as a solvent for the oil-desensitizing solution. As the water, distilled water, deinonized water, water freed of solids by filtration, running water and so on can be used. The water content varies with the amounts of other components. In general, the water content is preferably in the range of from about 40 to about 95% by weight.

The oil-desensitizing solution preferably has a pH value from about 8 to about 14, and particularly preferably from 9 to 13.

The method of use of the oil-desensitizing solution is hereinafter described in detail.

A suitable amount of the oil-desensitizing solution as described above is applied to the surface of a lithographic printing plate produced by the electrophotographic process as described hereinafter, rubbed with a sponge so as to form a coating on the total surface, and then dried. This process can be carried out by the use of a commercially available automatic gum coater. This application of the oil-desensitizing solution permits removal substances responsible for contamination of the plate surface, makes non-image areas oil-desensitive, and further protects the plate surface.

The amount of the oil-desensitizing solution which can be applied is generaly from about 0.01 to about 5 $g/m^2$, preferably from 0.1 to 1 $g/m^2$, based on the amount of non-volatile components contained in the oil-desensitizing solution.

At the initial stage of printing, the gum on the plate surface is removed by washing with water (so-called de-gumming), and, thereafter, printing may be carried out according to the usual process, or printing can be carried out without application of the so-called de-gumming.

In the present invention, just after the start of printing, sufficiently satisfactory, sharp printed matter can be obtained, without production of a lot of unsatisfactory printed matter as occurs in the conventional method. Moreover, since non-image areas have strong hydrophilic properties, satisfactory prints which are free from printing contamination can be obtained.

The present invention is hereinafter described in more detail.

As electrically conductive substrates to be used in electrophotographic light-sensitive materials, plastic sheets having an electrically conductive surface or paper made solvent-impermeable and electrically conductive, and electrically conductive substrates having a hydrophilic surface, e.g., an aluminum plate, a zinc plate, or bimetallic plates such as a copper-aluminum plate, a copper-stainless steel plate, and a chromium-copper plate, or trimetal plates such as a chromium-copper-aluminum plate, a chromium-lead-iron plate, a chromium-copper-stainless stell plate, and the like are used. The thickness of the substrate is preferably 0.1 to 3 mm, and particularly preferably 0.1 to 0.5 mm. Of these substrates, an aluminum plate is suitable. The aluminum plate to be used in the present invention is a plate-shaped material of pure aluminum or an aluminum alloy containing small amounts of other atoms and is not critical in the composition thereof, i.e., aluminum plates made of conventionally known materials can be used.

The aluminum plate may be grained and anodized by conventional methods. Before graining, in order to remove rolling oil on the surface of the aluminum plate, degreasing with a surfactant or an alkaline aqueous solution is applied, if necessary. Graining can be carried out by a method in which the surface is mechanically roughened, a method in which the surface is electrochemically dissolved, or a method in which the surface is chemically dissolved in selected areas. As the method of mechanically roughening the surface, known methods as such as the ball sanding method, the brush graining method, the blast graining method, or the buff graining method can be employed. As the electrochemically roughening method, a method in which an AC or DC current is applied in a hydrochloric acid or nitric acid electrolyte can be employed. In addition, a combination of the above methods can be employed, as described, e.g., in JP-A-54-63902.

The alminum plate thus roughened is subjected to alkali etching and neutralization, if desired.

The aluminum plate thus treated is then anodically oxidized. Electrolytes which can be used in the anodic oxidation include sulfuric acid, phosphoric acid, oxalic acid, chromic acid, and mixed acids thereof. The concentration of the electrolyte is determined appropriately depending on the type of the electrolyte. Conditions for anodization treatment vary with the type of the electrolyte to be used and cannot be determined unconditionally. In general, it is preferred that the concentration of the electrolyte is from about 1 to about 80% by weight, the liquid temperature is from about 5° to about 70° C., the current density is from about 5 to about 60 $A/dm^2$, the voltage is from about 1 to about 100 V, and the electrolytic time is from about 10 seconds to about 50 minutes. The amount of the anodized aluminum coating is preferably from 0.1 to 10 $g/m^2$, and more preferably from 1 to 6 $g/m^2$.

By providing an electrophotographic light-sensitive layer (photoconductive layer) on the electrically conductive substrate as obtained above, an electrophotographic light-sensitive material can be obtained.

As photoconductive materials to be used in the photoconductive layer, a number of conventionally known organic or inorganic compounds can be used. For example, as photoconductive materials which can be dispersed, inorganic photoconductive materials, e.g., selenium, selenium-tellurium, cadmium sulfide and zinc oxide can be used. As organic photoconductive compounds the following can be used.

(1) Triazole derivatives as described in U.S. Pat. No. 3,112,197, etc.

(2) Oxadiazole derivatives as described in U.S. Pat. No. 3,189,447, etc.

(3) Imidazole derivatives as described in JP-B-37-16096, etc.

(4) Polyarylalkane derivatives as described in U.S. Pat. Nos. 3,615,402, 3,820,989 and 3,542,544, JP-B-45-555 and JP-B-51-10983, and JP-A-51-93224, JP-A-55-108667, JP-A-55-156953 and JP-A-56-36656, etc.

(5) Pyrazoline or pyrazolone derivatives as described in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, etc.

(6) Phenylenediamine derivatives as described in U.S. Pat. No. 3,615,404, JP-B-51-10105, JP-A-46-3712 and JP-B-47-28336, JP-B-54-83435, JP-A-54-110836 and JP-A-54-119925, etc.

(7) Arylamine derivatives as described in U.S. Pat. Nos. 3,567,450, 3,180,703, 3,240,597, 3,658,520, 4,232,103, 4,175,961, and 4,012,376, West German Patent (DAS) 1,110,518, JP-B-49-35702 and JP-B-39-27577, JP-A-144250, JP-A-56-119132 and JP-A-56-22437, etc.

(8) Amino-substituted chalcone derivatives as described in U.S. Pat. No. 3,526,501.

(9) N,N-bicarbazyl derivatives as described in U.S. Pat. No. 3,542,546, etc.

(10) Oxazole derivatives as described in U.S. Pat. No. 3,257,203, etc.

(11) Styrylanthrathene derivatives as described in JP-A-56-46234, etc.

(12) Fluorenone derivatives described in JP-A-54-110837, etc.

(13) Hydrazone derivatives as described in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749 and JP-A-57-104144, etc.

(14) Benzidine derivatives as described in U.S. Pat. Nos. 4,047,948, 4,047,949, 4,265,990, 4,273,846, 4,299,897 and 4,306,008, etc.

(15) Stilbene derivatives as described in JP-A-58-190953, JP-A-59-95540, JP-A-59-97148, JP-A-59-195658 and JP-A-62-36674, etc.

In addition to the above low molecular photoconductive compounds, the following polymer compounds can be used.

(16) Polyvinyl carbazole and its derivatives as described in JP-B-34-10966.

(17) Vinyl polymers, e.g., polypyrene, polyvinyl anthracene, poly(2-vinyl-4-(4'-dimethylaminophenyl)-5-phenyloxazole), and poly(3-vinyl-N-ethylcarbazole), as described in JP-B-43-18674 and JP-B-43-19192.

(18) Polymers, e.g., polyacenaphthylene, polyindene and a copolymer of acenaphthylene and styrene, as described in JP-B-43-19193.

(19) Condensation resins, e.g., a pyreneformaldehyde resin, a brompyrene-formaldehyde resin and an ethylcarbazole-formaldehyde resin as described in JP-B-56-13940, etc.

(20) Various triphenylmethane polymers as described in JP-A-56-90883 and JP-A-56-61550.

For the purpose of e.g., increasing the sensitivity of the photoconductive material or providing the desired light-sensitive wavelength region, various pigments or dyes and the like can be used. Typical examples are shown below.

(1) Monoazo, bisazo or trisazo dyes as described in U.S. Pat. Nos. 4,436,800 and 4,439,506, JP-A-47-37543, JP-A-58-123541, JP-A-58-192042, JP-A-58-219263, JP-A-56-78356, JP-A-60-179746, JP-A-61-148453 and JP-A-61-238063, JP-A-60-5941 and JP-A-60-45664, etc.

(2) Phthalocyanine dyes, e.g., metal phthalocyanine and non-metal phthalocyanine, as described in U.S. Pat. Nos. 3,397,086 and 4,666,802, etc.

(3) Perylene pigments as described in U.S. Pat. No. 3,371,884, etc.

(4) Indigo or thioindigo derivatives as described in British Patent No. 2,237,680, etc.

(5) Quinacridone pigments as described in British Patent No. 2,237,679, etc.

(6) Polycyclic quinone pigments as described in British Patent No. 2,237,678, JP-A-59-184348 and JP-A-62-28738, etc.

(7) Bisbenzimidazole pigments as described in JP-A-47-30331, etc.

(8) Squalium salt pigments as described in U.S. Pat. Nos. 4,396,610 and 4,644,082, etc.

(9) Azulenium salt pigments as described in JP-A-59-53850 and JP-A-61-212542, etc.

As sensitizing dyes, known compounds as described in Sensitizer, Kodansha, p. 125, 81987, *Electrophotography*, 12, 9 (1973), *Organic Synthesis Chemistry*, 24, No. 11 1010 (1966) etc. can be used. Typical examples are shown below.

(10) Pyrylium dyes as described in U.S. Pat. Nos. 3,141,770, and 4,283,475, JP-B-48-25658, JP-A-62-71965, etc.

(11) Triarylmethane dyes as described in *Applied Optics Supplement*, Vol. 3, p. 50 (1969), JP-A-50-39548, etc.

(12) Cyanine dyes as described in U.S. Pat. No. 3,597,196, etc.

(13) Styryl dyes as described in JP-A-60-163047, JP-A-59-164588 and JP-A-60-252517, etc.

These organic photoconductive materials can be used alone or as mixtures comprising two or more thereof.

For the purpose of increasing sensitivity, to the photoconductive layer of the present invention, electron attractive compounds, e.g., trinitrofluorenone, chloranil and tetracyanoethylene, and compounds as described in JP-A-58-65439, JP-A-58-102239, JP-A-58-129439, and JP-A-62-71965, etc., can be added.

In a light-sensitive material for production of an electrophotographic printing plate, a photoconductive compound itself sometimes has film-forming properties. In the case that the photoconductive compound does not have film-forming properties, a binder resin can be used. As the binder resin, known resins in the field of electrophotography can be used. In preparation of a printing plate using a light-sensitive material for the electrophotographic printing plate, it is necessary to finally remove the photoconductive layer present on non-image areas. This process is determined depending on the relative relationship such as solubility of the photoconductive layer in an etching solution or resist properties of a toner image to the etching solution, and suitable conditions therefor can be appropriately selected by one ordinary skilled in the art. As the binder resin, polymeric compounds soluble or dispersible in an etching solution as described hereinafter are preferably used.

Specific examples are copolymers of acrylic acid ester, methacrylic acid ester, styrene, vinyl acetate, etc., and carboxylic acid-containing monomers, e.g., acrylic acid, methacrylic acid, itaconic acid, crotonic acid, maleic acid, maleic anhydride, fumaric acid, etc., or acid anhydride group containing monomers, such as a copolymer of styrene and maleic anhydride, a copolymer of styrene and maleic anhydride monoalkyl ester, a methacrylic acid/methacrylic acid ester copolymer, a styrene/methacrylic acid/methacrylic acid ester copolymer, an acrylic acid/methacrylic acid ester copolymer, a sryrene/acrylic acid/methacrylic acid ester copolymer, a vinyl acetate/crotonic acid methacrylic acid ester copolymer, and the like, copolymers containing methacrylamide, vinyl pyrrolidone, and monomers having a phenolic hydroxyl group, a sulfonic acid group, a sulfonamide group, or a sulfonimide group, a phenol resin, a partially saponified vinyl acetate resin, a xylene resin, a vinyl acetal resin, e.g., polyvinyl butyral, and the like.

Copolymers containing a monomer having an acid anhydride group or a carboxylic acid group as a copolymerization component, and a phenol resin can be used with good results because the photoconductive layer of the light-sensitive material has an electric charge holding power.

A preferred example of copolymers containing a monomer having an acid anhydride group as a copolymerization component is a styrene-maleic anhydride copolymer. In addition, the half ester of the copolymer can be used. Preferred examples of copolymers containing a monomer having a carboxylic acid group as a copolymerization component are two or more component copolymers of acrylic acid or methacrylic acid and alkyl ester, aryl ester or aralkyl ester of acrylic acid or methacrylic acid. Other preferred examples include a copolymer of vinyl acetate and crotonic acid, and a terpolymer of vinyl acetate, vinyl ester of carboxylic acid having 2 to 18 carbon atoms, and crotonic acid. Of such phenol resins, a novolak resin obtained by condensing phenol, o-cresol, m-cresol, or p-cresol and formaldehyde or acetoaldehyde under acidic conditions is particularly preferred. Binder resins can be used alone or as mixtures comprising two or more thereof.

When a photoconductive compound and a binder are used in combination, if the amount of the photoconductive compound used is too small, sensitivity is decreased. Thus the amount of the photoconductive compound used is preferably at least 0.05 part by weight, more preferably at least 0.1 part by weight per part by weight of the binder resin. If the thickness of the photoconductive layer is too small, a necessary amount of electric charge for development is not charged. On the other hand, if it is too large, etching in a plane direction, which is called side etching, is caused and no good image can be obtained. Thus the thickness of the photoconductive layer is preferably from 0.1 to 30 μm, and more preferably from 0.5 to 10 μm.

The printing plate for the electrophotographic printing plate of the present invention is obtained by coating a photoconductive layer on an electrically conductive substrate by a conventional method. For formation of the photoconductive layer, a method in which a component constituting the photoconductive layer is incorporated in the same layer, a method in which the component constituting the photoconductive layer is divided and incorporated into two or more layers, and a method in which an electric charge carrier-generating substance and an electric charge carrier-transferring substance are separately incorporated into different layers, and so forth are known. By any of the above methods, it can be formed. A coating solution is prepared by dissolving components constituting the photoconductive layer in a suitable solvent. When components insoluble in a solvent, e.g., pigments, are used, they are typically ground to a particle diameter of from 5 to 0.1 μm by the use of a dispersing machine, e.g., ball mill, paint shader, dinomill and attritor. A binder resin and other additives to be used in the photoconductive layer can be added at the time of dispersing the pigment and the like, or after the dispersion of the pigment. The printing plate for electrophotographic printing plate can be obtained by coating the above coating solution on a substrate by known techniques such as rotary coating, blade coating, knife coating, reverse roll coating, dip coating, a rod bar coating and spray coating. Solvents which can be used in the preparation of the coating solution include halogenated hydrocarbons, e.g., dichloromethane, dichloroethane and chloroform, alcohols, e.g., methanol and ethanol, ketones, e.g., acetone, methyl ethyl ketone and cyclohexanone, glycol ethers, e.g., ethylene glycol monomethyl ether and 2-mehoxyethyl acetate, ethers, e.g., tetrahydrofuran and dioxane, and esters, e.g., ethyl acetate and butyl acetate.

In addition to a photoconductive compound and a binder resin, if necessary, a plasticizer, a surfactant and other additives can be added to the photoconductive layer for the purpose of improving physical properties such as flexibility and the state of coated surface of the photoconductive layer. As the plasticizer, biphenyl, chlorinated biphenyl, o-terphenyl, p-terphenyl, dibutyl phthalate, dimethyl glycol phthalate, dioctyl phthalate and triphenyl phosphate can be used.

The printing plate used in the present invention can be produced using the aforementioned electrophotographic light-sensitive material according to the known process. That is, the light-sensitive material is substantially uniformly charged in a dark place and then imagewise exposure is applied to form an electrostatic latent image. For the imagewise exposure, scanning exposure using a semiconductor laser, He-Ne laser, etc., or reflection imagewise exposure using a xenon lamp, a tungusten lamp, or a fluorescent lamp as a light source, or contact exposure through a transparent positive film, can be employed.

Then, the above electrostatic latent image is developed with toners. For this development, conventionally known techniques such as cascade development, magnetic brush development, powder cloud development and liquid development can be employed. Of these, liquid development is quite suitable for production of a printing plate, in that it permits formation of a fine image. The toner image thus formed can be fixed by known techniques, such as heat fixing, pressure fixing and solvent fixing. The toner image thus formed is used as a resist, and by removing the photoconductive layer on non-image areas with an echant, a printing plate is obtained.

As the echant to be used in removing the photoconductive insulating layer on non-image areas after the formation of the toner image, any suitable solvent can be used as long as it is capable of removing the photoconductive insulating layer. Preferably an alkaline solvent is used. The alkaline solvent as used herein refers to an aqueous solution containing an alkaline compound, or an organic solvent containing an alkaline compound, or a mixture of an aqueous solution and an organic solvent, containing an alkaline compound. Examples of the alkaline compound are organic or inorganic compounds, e.g., sodium hydroxide, potassium hydroxide, sodium carbonate, sodium silicate, potassium silicate, sodium metasilicate, potassium metasilicate, sodium phosphate, potassium phosphate, ammonia, and aminoalcohols such as monoethanolamine, diethanolamine, and triethanolamine. As the solvent for the etchant, as described above, water or a number of organic solvents can be used. From the viewpoints of odor and pollution, an etchant containing water as a main component is preferably used. To the etchant containing water as a main component, various organic solvents can be added, if desired. Preferred organic solvents are lower alcohols or aromatic alcohols, e.g., methanol, ethanol, propanol, butanol, benzyl alcohol, and phenethyl alcohol, ethylene glycol, diethylene glycol, triethylene glycol, polyethylene glycol, cellosolves, and aminoalcohols, e.g., monoethanolamine, diethanolamine and triethanolamine. In addition to the etchant, a surfactant, a defoaming agent and other various additives can be added, if desired.

It is preferred for the toner forming image areas to contain a resin component having resist properties to the above etchant. Resins which can be used as the resin component include acryl resins using methacrylic acid, methacrylic acid ester, etc., a vinyl acetate resin, copolymers of vinyl acetate and ethylene, vinyl chloride or the like, a vinyl chloride resin, a vinylidene chloride resin, a vinyl acetal resin, e.g., polyvinyl butyral, polystyrene, copolymers of styrene and butadiene, methacrylic acid ester, and the like, polyethylene, polypropylene and their chlorinated products, polyester resins (e.g., polyethylene terephthalate, polyethylene isophthalate, and polycarbonate of bisphenol A), polyamide resins (e.g., polycapramide, polyhexamethyleneadipoamide and polyhexamethylenesebacamide), phenolic resins, xylene resins, alkyd resins, vinyl-modified alkyd resins, gelatin, cellulose ester derivatives such as carboxymethyl cellulose, wax, polyolefin wax and the like.

In the light-sensitive material for electrophotographic printing plate which is to be used in the present invention, between the electrically conductive substrate and the photoconductive layer, if necessary, an intermediate layer comprising casein, polyvinyl alcohol, ethyl cellulose, a phenol resin, a styrenemaleic anhydride copolymer, polyacrylic acid, monoethanolamine, diethanolamine, trimethanolamine, tripropanolamine, triethanolamine and their hydrochloric acid salts, oxalic acid salts or phosphoric acid salts, and monoaminomonocarboxylic acid, e.g., aminoacetic acid and alanine; oxyamino acid, e.g., cerin, threnione, and dihydroxyethylglycine; sulfur-containing amino acid, e.g., cystine and cysteine; monoaminodicarboxylic acid, e.g., asparaginic acid and glutanic acid; aromatic nucleus-containing amino acid, e.g., p-hydroxyphenylglycine, phenylalanine, and anthranyl acid; hetero ring-containing amino acid, e.g., tryptophane and proline, aliphatic aminosulfonic acid, e.g., sulfamic acid and cyclohexylsulfamic acid; (poly)aminopolyacetic acid, e.g., ethylenediaminetetraacetic acid, nitrilotriacetic acid, iminodiacetic acid, hydroxyethyliminodiacetic acid, hydroxyethylethylenediaminetriacetic acid, ethylenediaminediacetic acid, cyclohexanediaminetetraacetic acid, diethylenetriaminepentaacetic acid and glycol etherdiaminetetraacetic acid; sodium, potassium or ammonium salts, partial or full, of an acid group of the above compound; or the like can be provided for the purpose, e.g., of improving adhesion between the above substrate and the photoconductive layer, electrostatic characteristics of the photoconductive layer, dissolution properties and/or printing properties.

An overcoat layer capable of being dissolved at the time of removing the photoconductive layer can be provided on the photoconductive layer, if desired, for the purpose of improving electrostatic characteristics of the photoconductive layer, developing characteristics at the time of toner development, or image characteristics. This overcoat layer may be mechanically matted or may be a resins layer containing a matting agent. Matting agents which can be used include silicon dioxide, zinc oxide, titanium oxide, zirconium oxide, glass beads, alumina, starch, polymer particles (particles of, e.g., polymethylmethacrylate, polystyrene or a phenol resin), and those described in U.S. Pat. Nos. 2,710,245 and 2,992,101. These can be used as mixtures comprising two or more thereof. The resin to be used in the resin layer containing a matting agent is determined appropriately depending on the type of the etchant. More specifically, gum arabic, glue, gelatin, casein, celluloses (e.g., viscose, methyl cellulose, ethyl cellulose, hydroxyethyl cellulose, hydroxypropylmethyl cellulose, or carboxymethyl cellulose), starches (e.g., soluble starch or modified starch), polyvinyl alcohol, polyethylene oxide, polyacrylic acid, polyacrylamide, polyvinyl methyl ether, an epoxy resin, a phenol resin (preferably a novolak type phenol resin), polyamide, polyvinyl butyral and the like can be used. These can be used as mixtures comprising two or more thereof.

The present invention is described in greater detail with reference to the following examples, but the present invention is not limited thereto. Unless otherwise indicated, all parts are by weight.

EXAMPLE 1

The surface of a JIS 1050 aluminum sheet was grained with a rotary Nylon brush using a pumice-water suspension as an abrasive. The surface irregularities at this time (the average central line roughness) was 0.5 μm. After rinsing with water, the aluminum sheet was etched by dipping in a 10% aqueous sodium hydroxide solution maintained at 70° C. so that the amount of aluminum dissolved was 6 g/m$^2$. After rinsing with water, the aluminum sheet was neutralized by dipping in a 30% aqueous nitric acid solution for one minute and, thereafter, thoroughly rinsed with water. Then, electrolytic roughening was conducted in a 0.7% aqueous nitric acid solution by the use of rectangular AC wave at an anode voltage of 13 volts and cathode voltage of 6 volts (as described in JP-B-55-19191). After cleaning the resulting surface by dipping in a 20% sulfuric acid solution maintained at 50° C., the aluminum sheet was rinsed with water. Moreover, anodization was applied in a 20% aqueous sulfuric acid solution so that the weight of the anodized film was 3.0 g/m$^2$, and then the aluminum sheet was rinsed with water and dried to produce a substrate.

On this substrate was coated a coating solution for a photoconductive layer as described below, which was then dried at 120° C. for 10 minutes to produce a light-sensitive material for an electrophotographic printing plate.

| Coating Solution for Photoconductive Layer | |
|---|---|
| Hydrazone having the formula: | 25 parts |

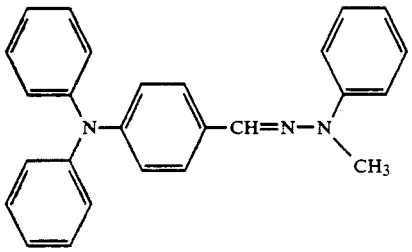

| | |
|---|---|
| Copolymer of benzyl methacrylate and methacrylic acid (methacrylic acid, 30 mol %) | 75 parts |
| Thiopyrylium salt compound having the formula: | 1.18 parts |

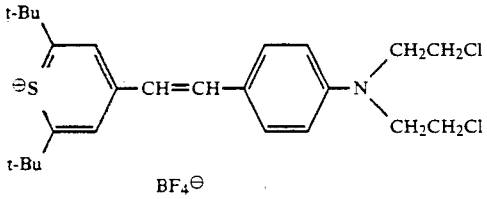

| | |
|---|---|
| Methylene chloride | 510 parts |
| Methyl cellosolve acetate | 150 parts |

The dry film thickness of the light-sensitive material as produced above was 4 μm.

This light-sensitive material was charged to a surface potential of +400 V in a dark place by the use of a corona charging machine, exposed to tungusten light, and then developed with a liquid developer, Ricoh MRP (produced by Ricoh Corp.) to obtain a sharp positive image. The image thus produced was heated at 120° C. for 2 minutes to fix the toner image.

Non-image areas were removed with an etchant prepared by diluting 40 parts of potassium silicate, 10 parts of potassium hydroxide, and 100 parts of ethanol with 800 parts of water, and then thoroughly rinsing with water.

An oil desensitizing solution A to be used in the present invention was prepared as follows.

| Oil-desensitizing Solution A | |
|---|---|
| Hydroxypropyl etherized starch (degree of substitution, 0.05) | 60 parts |

-continued

| Oil-desensitizing Solution A | |
|---|---|
| Potassium silicate solution (52Be': 20° C.) | 18 parts |
| Potassium hydroxide (48.5%) | 8 parts |
| Pure water | 914 parts |

The light-sensitive material which had been subjected to a series of electrophotographic and etching treatments as described above was treated with the above oil-desensitizing solution to produce a printing plate.

COMPARATIVE EXAMPLE 1

Oil-desensitization treatment was carried out using the same oil-desensitizing solution A as used in Example 1, except that potassium silicate was omitted from the solution.

COMPARATIVE EXAMPLE 2

Oil-desensitization treatment was carried out using the same oil-desensitizing solution A as used in Example 1, except that hydroxypropyletherized starch was omitted from the solution.

COMPARATIVE EXAMPLE 3

In this example, no oil-desensitization treatment was applied after etching.

The above four types of printing plates were mounted on Oliver 52 (Molton printing machine) and repeated printing was conducted. The ink was DIC CAPS-G ink (produced by Dai Nippon Ink Co., Ltd.), and dampening water was EU-3 (produced by Fuji Photo Film Co., Ltd.) diluted with water at 1:100.

With the plate of Example 1, more than 100,000 prints could be obtained without generation of stains, whereas, with the plate of Comparative Example 1, low density ink staining was observed over the whole non-image areas from the start of printing. Because of unexpected jamming of printing paper after about 1,000 sheets had been printed, the printing machine was stopped. However, from the start to the end of printing, stains did not disappear. With the plate of Comparative Example 2, finger prints and inexplicable staining was significant, and the plate was unstable to external factors. With the plate of Comparative Example 3, serious background stains, finger prints, scratches, and dot-like stains were observed to a significant extent, and the plate was judged to be unsuitable for practical use.

EXAMPLE 2

A light-sensitive material was produced by coating the substrate of Example 1 with a dispersion for an electrophotoconductive layer as described below by the use of a bar coater.

| Dispersion for Photoconductive Layer | |
|---|---|
| Trisazo compound | 1.0 part |

-continued

Dispersion for Photoconductive Layer

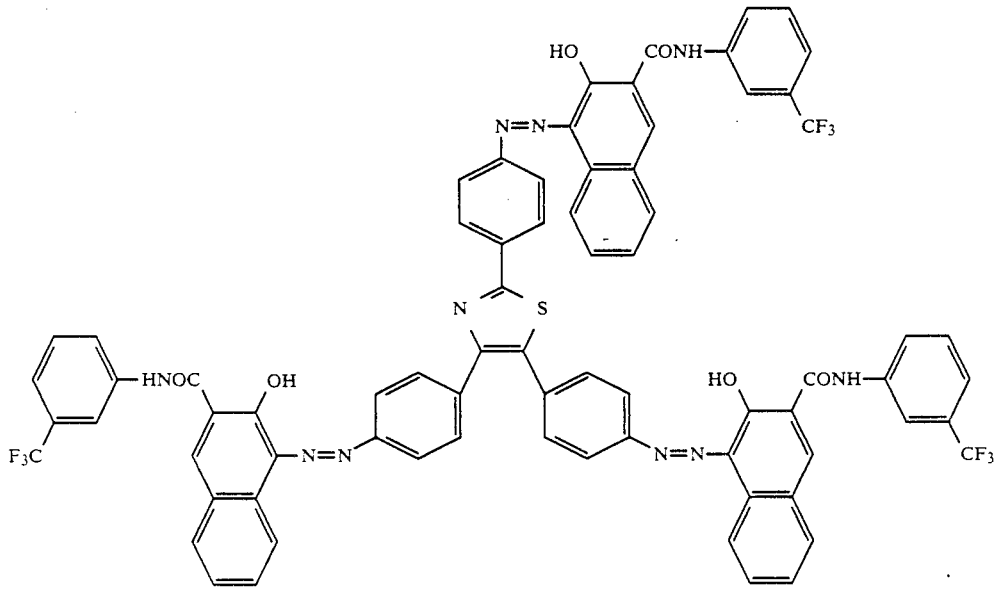

Oxazole compound 2.5 parts

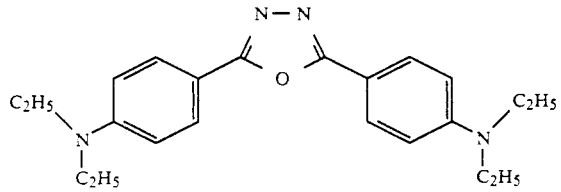

Copolymer of vinyl acetate and crotonic acid (RESYN No. 28-1310, produced by Kanebo F.N.C. CO., Ltd.) 10 parts Tetrahydrofuran 100 parts These ingredients were placed along with glass beads in a 500 milliliter glass container and then dispersed for 60 minutes on a paint shaker (produced by Toyo Seiki Seisakusho Co., Ltd.) to prepare a dispersion for a photoconductive layer.

The thickness of the photoconductive layer was about 4 μm. This was subjected to toner development, etching, and water rinsing in the same manner as in Example 1.

An oil-desensitizing solution B used in the present invention was prepared as follows.

| Oil-desensitizing Solution B | |
|---|---|
| Sodium polyacrylic acid | 40 parts |
| Potassium silicate solution (52Be': 20° C.) | 20 parts |
| Potassium hydroxide (48.5%) | 10 parts |
| Sodium butylnaphthalenesulfonate | 5 parts |
| Pure water | 925 parts |

The same operation as in Example 1 was conducted using the oil-desensitizing solution B.

COMPARATIVE EXAMPLE 4

Oil-desensitization treatment was carried out in the same manner as described in Example 1 except that an oil-desensitizing solution B of Example 2 from which potassium silicate was omitted was used. A printing test was carried out in the same manner as in Example 1.

With the plate of Example 2, more than 100,000 prints could be obtained, and the background stain was much decreased than in Example 1. On the other hand, with the plate of Comparative Example 4, when 3,000 sheets were printed, staining was initially observed, and the staining increased thereafter.

EXAMPLE 3

A light-sensitive material was produced by coating the substrate of Example 1 with a dispersion for electrophotographic layer as described below by the use of a bar coater.

| Dispersion for Photoconductive Layer | |
|---|---|
| ε type copper phthalocyanine | 1.0 part |
| Hydrazone compound having the formula: | 2.5 parts |

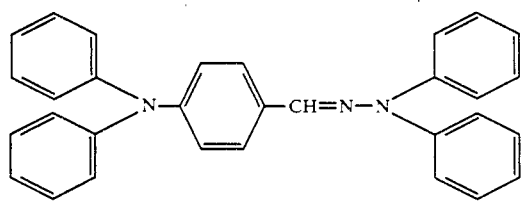

-continued

| Dispersion for Photoconductive Layer | |
|---|---|
| Copolymer of benzyl methacrylate and methacrylic acid (benzyl methacrylate, 60 mol %) | 10 parts |
| Tetrahydrofuran | 100 parts |

These ingredients were placed along with glass beads in a 500-milliliter glass container and dispersed for 60 minutes by the use of a paint shaker (produced by Toyo Seiki Seisakusho Co., Ltd.). Thereafter, the same operation as in Example 1 was conducted using the same oil-desensitizing solution as described in Example 1, with substantially the same results as in Example 1.

By treating with an oil-desensitizing solution containing silicic acid salt, water-soluble resin and water, substances responsible for contamination could be removed from a lithographic printing plate produced by an electrophotographic process, and, at the same time, oil-desensitization could be achieved, thereby effectively protecting the surface of the plate.

Moreover, in accordance with the method of the present invention, the oil-desensitizing solution can be easily applied to the surface of the plate, and can be easily removed therefrom, and furthermore the hydrophilic properties of non-image areas can be maintained.

While the invention has been described in detail and with reference to specific embodiments thereof, it will be apparent to one skilled in the art that various changes and modifications can be made therein without departing from the spirit and scope thereof.

What is claimed is:

1. A method for oil-desensitization treatment of a lithographic printing plate having image areas of toner image formed by an electrophotographic process on a photoconductive layer provided on an electrically conductive substrate, and non-image areas of the electrically conductive substrate, which method comprises treating the plate with an aqueous solution containing a silicate represented by the formula $SiO_2/M_2O$ (wherein M is an alkali metal atom) and a water-soluble resin.

2. A method for oil-desensitization treatment of a lithographic printing plate as in claim 1, wherein said silicate has a molar ratio of $SiO_2$ to $M_2O$ in the range of from 0.5:1 to 8.5:1.

3. A method for oil-desensitization treatment of a lithographic printing plate as in claim 1, wherein said water-soluble resin is present in said aqeuous solution in an amount of from about 1 to about 30% by weight.

4. A method for oil-desensitization treatment of a lithographic printing plate as in claim 1, wherein said aqueous solution further contains at least one of an anionic surface active agent, a nonionic surface active agent and a mixture thereof.

5. A method for oil-desensitization treatment of a lithographic printing plate as in claim 1, wherein said aqueous solution has a water content in the range of from 40 to about 95% by weight.

6. A method for oil-desensitization treatment of a lithographic printing plate as in claim 1, wherein said aqueous solution has a pH value from about 8 to about 14.

* * * * *